United States Patent [19]

Basseches

[11] 4,326,766

[45] Apr. 27, 1982

[54] OPTIONALLY FUSED CONNECTOR DEVICE

[76] Inventor: Mark T. Basseches, 420 Lexington Ave., New York, N.Y. 10017

[21] Appl. No.: 144,263

[22] Filed: Apr. 28, 1980

[51] Int. Cl.[3] ..... H01R 29/00; H01R 3/00; H01H 85/04; H01H 85/28

[52] U.S. Cl. ..... 339/31 R; 339/147 R; 337/167; 337/288

[58] Field of Search ..... 339/147 R, 147 C, 147 P, 339/31 R, 31 L, 31 T; 337/221, 228, 261, 167, 4, 8, 5, 198

[56] References Cited

U.S. PATENT DOCUMENTS

| | | | |
|---|---|---|---|
| 1,674,339 | 6/1928 | Nass | 337/5 |
| 2,644,056 | 6/1953 | Curtis | 337/198 |
| 3,027,438 | 3/1962 | Reutter | 337/167 |
| 3,474,373 | 10/1969 | Myers | 337/8 |

*Primary Examiner*—Nicholas P. Godici
*Assistant Examiner*—Robert A. Rose
*Attorney, Agent, or Firm*—Mark T. Basseches; Paula T. Basseches

[57] ABSTRACT

This invention relates to a connector device, and more particularly to an electrical connector plug, jack, tapping device or receptacle which provides a direct current path between an input and an output terminal, which path is automatically opened responsive to the insertion of a fuse, after which the sole conductive path between the terminals extends through the fuse.

10 Claims, 5 Drawing Figures

OPTIONALLY FUSED CONNECTOR DEVICE

BACKGROUND OF THE INVENTION

1. Field of the Invention

The present invention is in the field of connector devices, and relates more particularly to an electrical connector plug, jack or receptacle.

2. The Prior Art

It is conventional to employ, as means for drawing current from or distributing current to an electrical apparatus, a plug or like tapping or connector appliance which comprises an insulating body housing one or more contacts which may project from or be recesssed within the body. As an example of such device, there may be mentioned the single or double probe devices known as "banana" plugs which include a projecting conductive portion and an input terminal to which an electrical conduit can be affixed. Such banana plugs are, for instance, frequently attached to the terminal ends of wires extending from an audio amplifier and provide a convenient means for effecting electrical connection to a loudspeaker provided with suitable receptor sockets for the plug.

In many instances it is desired to insert a fuse in series with an electrical device, as exemplified by a loudspeaker, which does not have internal fusing provisions. For such purpose, there may be employed so-called in-line fuse holders. The use of in-line fuse holders requires splicing, soldering and the application of insulating tape, making for and unsightly and often an unsafe or electrically resistive condition.

SUMMARY OF THE INVENTION

The present invention may be summarized as directed to a connector device, such as a banana plug (although it is by no means limited to such form of connector) which is adapted to provide a direct electrical connection from input to output terminal and which further includes a chamber or receiver for a fuse.

The device is characterized by the direct connection between the input and output terminals being opened in response to insertion of the fuse, such insertion functioning to place the fuse in series between the input and output terminals whereby the fuse defines the sole conductive path between such terminals.

The invention further relates to an electrical connector device of the type described wherein the direct terminal-to-terminal path is automatically opened responsive to insertion of the fuse, being maintained in the desired open condition upon failure of the fuse until the fuse is removed.

The invention further relates to a connector device which is convenient to use, inexpensive to manufacture and effective for its intended purpose.

Accordingly, it is an object of the present invention to provide a connector device for effecting electrical connection from an electrical source to an electrical appliance which may be used in an unfused manner but which may introduce a fuse in series between the source and appliance by the mere insertion of a fuse into a chamber provided therefor.

BRIEF DESCRIPTION OF THE DRAWINGS

To attain these objects and such further objects as may appear herein or be hereinafter pointed out, reference is made to the accompanying drawings forming a part hereof in which.

DESCRIPTION OF THE PREFERRED EMBODIMENTS

Figure 1:
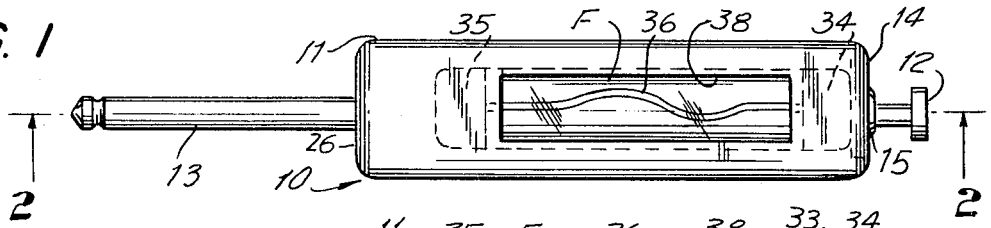
FIG. 1 is a top plan view of an electrical connector in accordance with the invention.

Referring now to the drawings, there is disclosed a simple form of connector mechanism 10 which comprises an insulating body 11 of polymeric material or the like having an input terminal 12 for connection to an electrical lead, and an output terminal 13 in the form of a probe. It will be readily recognized that the terminal 12 may include the conventional screw clamp for the input lead or may, as shown, comprise a solder attachment lug.

Similarly, while the output terminal or probe 13 of the illustrated embodiment comprises merely a cylindrical metallic member, the same may be formed of any conventional desired shape, such as the rectangular section familiarly employed as the male plug for lamps, toasters and other electrical appliances, or may be recessed within the insulating body.

Figure 2:
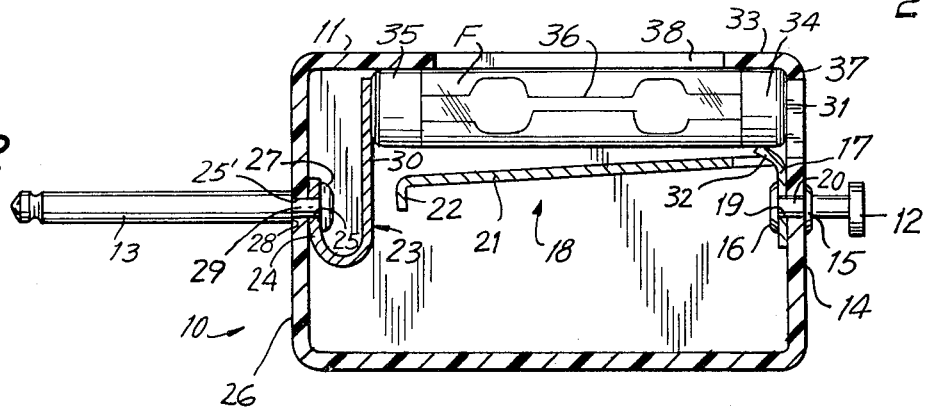
FIG. 2 is a vertical section taken on the line 2—2 of FIG. 1 showing the position of the parts when the device is used as a fused mechanism.
Figure 3:
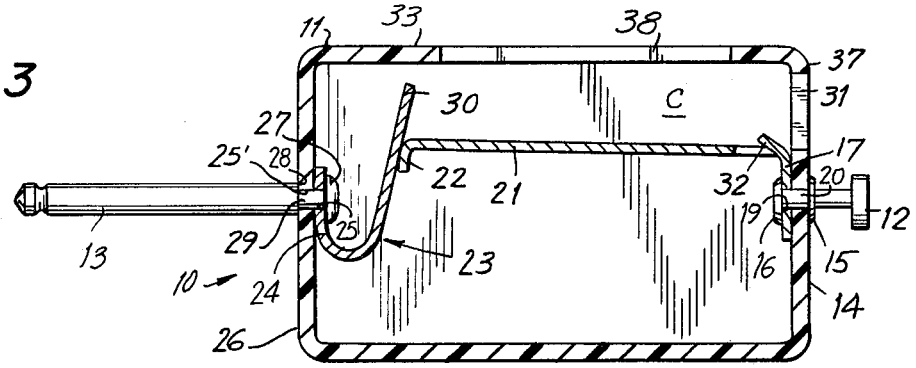
FIG. 3 is a section similar to FIG. 2 showing the position of the parts with the fuse removed.

Referring now to the embodiment of FIGS. 1 through 3 wherein like parts have been given like reference numerals, the input terminal 12 is clamped to wall 14 by spaced conductive shoulders 15, 16 extending through the wall. Shoulder 16 bears against the vertical leg 17 of a generally L-shaped conductor 18, the leg 17 having an aperture 19 through which passes shank 20 of terminal 12.

It will thus be seen that the leg 17 and, hence, the conductor 18, are electrically connected to the terminal 12 and mechanically supported on wall 14. The conductor 18 includes a forwardly directed leg 21 terminating in contact portion 22.

The output terminal 13 is connected to a resilient, generally U-shaped conductor 23 having a forward leg portion 24 provided with an aperture 25. The leg 24 is fixed against the forward wall 26 of the body portion by staking a headed portion 27 against the inner surface of leg 24 after shank 29 of the terminal has been passed through registering apertures 25' in wall 26, and 25 in leg 24.

The probe or terminal 13 includes a radially directed shoulder 28 which, after the heading operation, bears against the outer surface of the wall 26.

Referring now to FIG. 3, the shiftable leg 30 of conductor 23 is disclosed in its normal position in which said leg is resiliently biased against the contact portion 22 of conductor 18, the noted portions defining, in essence, a switch.

As seen in FIG. 3, a conductive path is thus defined between the input terminal 12 and the output terminal or probe 13 via conductor 18, contact portion 22, movable leg 30 and conductor 23.

The wall 14 of the body portion is provided with a fuse insertion aperture 31. Conductor 18 includes an upwardly extending tab 32 defining a switch control means. It will be appreciated that the area between the conductor 18 and the upper wall 33 defines a chamber C within which a conventional fuse F may be inserted.

In the illustrated embodiments the fuse is of the well known glass body type incorporating contact portions 34, 35 at its terminal ends, which contact portions are joined by an internal meltable link 36. When the fuse is inserted, as best seen in FIG. 2, the conductive end portion 35 thereof engages against the movable leg 30 of conductor 23 and shifts the same forwardly to the position shown in FIG. 2, whereat the leg is clear of engagement with the contact portion 22 of conductor 18.

In the inserted position of FIG. 2, the outer contact portion 34 of the fuse engages against tab 32 and the inner end 35 of the fuse engages against leg 30.

It will thus be apparent that an electrical path is defined between input terminal 12 and output terminal or probe 13, which path includes the fuse member F in series therewith. The fuse may be retained in position in any desired manner.

In accordance with the illustrated embodiment, the wall 14 includes a lip portion 37. When the fuse F is inserted, the resilient tab 32 is stressed downwardly by the insertion thereof and urges the end 34 of the fuse upwardly behind the lip 37, whereby the fuse is retained in mounted position.

Preferably, the upper wall 33 of the body portion is provided with a cut out area 38 in registry with the glass body of the fuse. The cut out wall, in addition to providing visual access to the fuse, permits inspection thereof and also provides manual access, enabling the fuse to be depressed against the force of the tab 32 so that the end 34 thereof may be cleared below the lip 37, following which the fuse will spring or be shiftable outwardly, enabling its removal.

Figure 4:
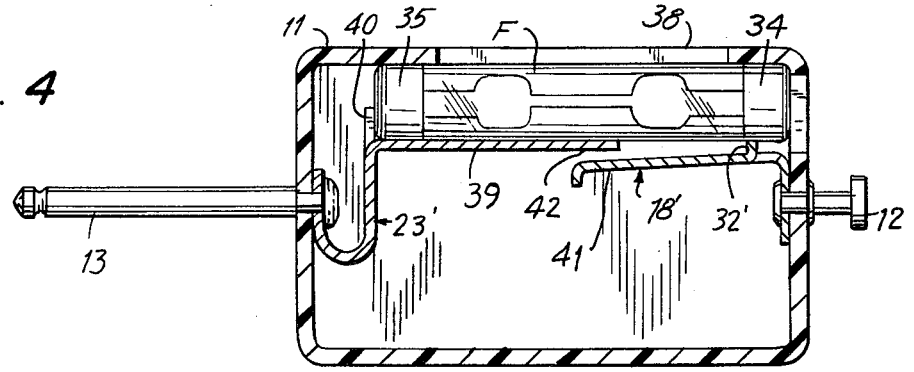
FIG. 4 is a section similar to FIG. 2 of a further embodiment of the invention.
Figure 5:
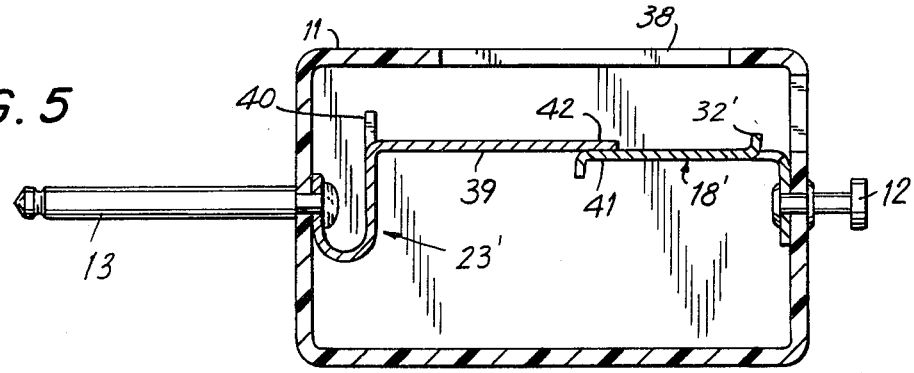
FIG. 5 is a view similar to the view of FIG. 3 of the embodiment of FIG. 4.

Referring now to FIGS. 4 and 5, there is disclosed a connector incorporating a modified switching arrangement.

In accordance with this embodiment the conductor 23' includes a rearwardly directed leg 39 and a stop and contact portion 40. The contact 18' extends generally forwardly toward the probe 13 such that a short end section 41 thereof underlies a rearwardly facing short section 42 of leg 39. In the non-fuse containing condition, the combined resilience of the conductors 18' and 23' maintain sections 41, 42 in conductive contact, as shown in FIG. 5. When a fuse F is inserted, as shown in FIG. 4, a slight anti-clockwise movement is imparted to the conductor 23' by engagement of the contact 35 of the fuse with the contact portion 40.

Similarly, an anti-clockwise movement is imparted to the conductor 18' by engagement of the tab 32' against contact 34 of the fuse, whereby the tab 32' acts as a switch operator means.

It will thus be appreciated that insertion of the fuse has interrupted the direct current path between the input terminal 12 and output terminal or probe 13 and the sole conductive path between such terminals now includes a series circuit through the fuse.

Removal of the fuse is accomplished in the same manner as described in connection with the embodiment of FIGS. 1 to 3.

The device may be used in the same manner as a conventional plug.

Where it is desired to fuse a system, it is necessary merely to insert a fuse into the chamber C, whereupon the fuse automatically forms part of the circuit to the powered appliance. In the event that a fuse should fail, it is preferable to remove the plug from its engaged contact with the powered device prior to removal of the fuse since removal of the fuse with the plug still in position will establish direct contact between the input and output terminals.

From the foregoing description it will be readily recognized that numerous variations in structural detail may be made without departing from the underlying concept, which is to provide an optionally fused plug wherein insertion of a fuse automatically interposes the fuse into an electrical path between normally connected terminal members.

While the device has been illustrated and described principally in connection with a conventional cylindrical glass fuse member, it is readily adapted for use with a screw-in type or cartidge type fuse by appropriate modification of the structure of the fuse receptor and internal switching arrangement operated by insertion of the fuse.

Additionally, the term "fuse" as used herein should be broadly construed to include a circuit breaker, being a known fuse equivalent.

Numerous other structural details, such as the arrangement of switching components and manner of their mechanical interconnection with the fuse will readily occur to those skilled in the art who are familiarized with the instant disclosure. Accordingly, the invention is to be broadly construed within the scope of the appended claims.

Having thus described the invention and illustrated its use, what is claimed as new and is desired to be secured by Letters Patent is:

1. An optionally fused connector device comprising a body portion of insulating material, input terminal means on said body portion for reception of an input lead, output terminal means on said body portion for engagement with a device to be powered, a fuse receiver chamber formed in said body portion and sized to receive a fuse member having first and second contacts, first and second connector leads extending respectively from said input and output terminal means, each said lead including a portion within said chamber positioned to engage one of said contacts of a fuse disposed in said chamber, switch means in said body portion normally connecting said input and output terminal means, and switch control means positioned to engage a fuse inserted into said chamber for opening said switch means responsive to insertion of a fuse into said chamber, thereby to insert said fuse as the sole connective path between said input and output terminal means said switch control means positioned to close said switch means responsive to removal of said fuse from said chamber.

2. Apparatus in accordance with claim 1 wherein said output terminal means comprises a probe extending from said body portion.

3. Apparatus in accordance with claim 1 wherein said switch means comprises a resilient contact member connected to one said terminal means, and said switch control means includes a portion of said contact member extending into said chamber in the path of said fuse.

4. Apparatus in accordance with claim 3 wherein said switch means includes, in addition, a second contact member electrically connected to the other said terminal means, said contact members being disposed in conductive engagement in the empty condition of said chamber and in spaced relation in the fuse inserted condition of said chamber.

5. Apparatus in accordance with claim 3 wherein said switch control means projects transversely into said chamber and is shifted generally radially inward to the switch opening position responsive to insertion of a fuse into said chamber.

6. Apparatus in accordance with claim 3 wherein said chamber comprises a bore having an outer end defining a mouth portion and an inner end, and said switch control means is disposed adjacent said inner end and shifted generally axially of said bore to the switch opening position responsive to insertion of a fuse into said chamber.

7. Apparatus in accordance with claim 6 wherein said chamber includes a cut out wall portion providing visual access to the interior of said chamber.

8. Apparatus in accordance with claim 7 wherein said cut out wall provides visual and manual access to the interior of said chamber, said apparatus including lip means adjacent said mouth portion for retaining said fuse in said chamber.

9. Apparatus in accordance with claim 8 wherein said switch control means in the inserted position of said fuse urges said fuse toward said lip means.

10. An optionally fused connector device comprising a body portion of insulating material, input terminal means on said body portion for reception of an input lead, output terminal means on said body portion for engagement with a device to be powered, a fuse receiver chamber formed in said body portion and sized to receive a fuse member having first and second contacts, first and second connector leads extending respectively from said input and output terminal means, each said lead including a portion within said chamber positioned to engage one of said contacts of a fuse disposed in said chamber, switch means in said body portion normally connecting said input and output terminal means, and spring urged switch control means positioned to engage a fuse inserted into said chamber for opening said switch means responsive to insertion of a fuse into said chamber and for yieldingly maintaining said contacts of said fuse in contacting position with said leads, thereby to insert said fuse as the sole connective path between said input and output terminal means said switch control means positioned to close said switch means responsive to removal of said fuse from said chamber.

* * * * *